US007195376B2

(12) United States Patent
Van De Poel

(10) Patent No.: US 7,195,376 B2
(45) Date of Patent: Mar. 27, 2007

(54) LAMP FOR GENERAL LIGHTING PURPOSES

(75) Inventor: Gunther Van De Poel, Kortenaken (BE)

(73) Assignee: Flowil International Lighting (Holding) B.V. (NL)

( * ) Notice: Subject to any disclaimer, the term of this patent is extended or adjusted under 35 U.S.C. 154(b) by 212 days.

(21) Appl. No.: 11/047,426

(22) Filed: Jan. 31, 2005

(65) Prior Publication Data

US 2005/0281035 A1 Dec. 22, 2005

(30) Foreign Application Priority Data

Jan. 29, 2004 (DE) ..... 10 2004 004 651

(51) Int. Cl.
*F21V 13/10* (2006.01)

(52) U.S. Cl. ..... 362/343; 362/263; 362/353; 362/539

(58) Field of Classification Search ..... 362/539, 362/376, 261, 263, 293, 510, 517, 343, 353; 313/110, 111, 113
See application file for complete search history.

(56) References Cited

U.S. PATENT DOCUMENTS 4,564,783 A * 1/1986 Krieg et al. ..... 313/113
4,747,029 A * 5/1988 Liverance et al. ..... 362/548
4,987,343 A * 1/1991 Kosmatka et al. ..... 315/82
5,036,439 A * 7/1991 Hoffmann et al. ..... 362/459
5,993,035 A * 11/1999 May et al. ..... 362/547

FOREIGN PATENT DOCUMENTS

| | | |
|---|---|---|
| DE | 83 10 535 U1 | 9/1983 |
| DE | 36 24 131 A | 7/1986 |
| DE | 35 40 130 C1 | 4/1987 |
| DE | 197 37 640 A1 | 3/1998 |
| DE | 198 31 852 A1 | 1/2000 |
| DE | 102 33 073 B3 | 2/2004 |
| EP | 942 223 A2 | 9/1999 |

* cited by examiner

*Primary Examiner*—Steve Husar
*Assistant Examiner*—Peggy A. Neils
(74) *Attorney, Agent, or Firm*—Brooks Kushman P.C.

(57) ABSTRACT

A lamp is made up a reflector, a base and a cover connected along their circumferences defining an inner cavity enclosing an arc tube coaxially oriented within the cavity and mounted to the base. A shroud surrounds the arc tube and is cemented to the base. An anti-glare cap and a clamping element is arranged between an end region on the side of the cover and the anti-glare cap affixed to the shroud via a clamping element.

14 Claims, 6 Drawing Sheets

LAMP FOR GENERAL LIGHTING PURPOSES

FIELD OF THE INVENTION

The invention concerns lamps for general illumination purposes having a reflector with a base and having a transparent cover plate, both being connected with each other along their circumference while forming an inner cavity, comprising an arc tube arranged essentially coaxially within the cavity and mounted in the base, and a shroud surrounding the arc tube and being fixable in the base by means of cement.

BACKGROUND ART

There is known an HID-reflector lamp of this kind (DE-A-102 33 073) in which a shroud is provided to avoid loss of sodium and for protection from shards in case of a possible explosion of the arc tube, the back lead for the feed current of the arc tube being arranged outside of the shroud for that such lead will be not exposed to the immediate UV-radiation of the arc tube. A cap for glare protection is not provided, in case of need it must be affixed externally, i. e. practically at the luminaire in which this lamp is used.

Further there is known a halogen-reflector lamp (Hi-Spot ES11; "Hi-Spot" is a registered trademark of applicant) which has an internal glare protection cap already that is supported by side supports which are secured at the glare protection cap on the one side and between reflector and cover plate on the other.

However, this structure is not only costly but also unfavourable because the path of the rays within the reflector and the visual or aesthetic appearance of the lamp, resp., are disturbed by the side supports. The optical efficiency is affected by the side supports as well.

In another known structure the anti-glare cap is already also mounted immediately on the cover or lens, resp., consisting of glass, by drilling a hole for its fixation in such cover or lens. However, by doing that the strength of the glass is reduced so that the lamp can not be regarded as safe and reliable any longer.

SUMMARY OF THE INVENTION

The object underlying the invention is seen in providing a lamp having the structure mentioned above initially which also, like the structure mentioned above in the second place, possesses an internal anti-glare cap, but has a support of such anti-glare cap which disturbs neither the path of radiation nor the optics, which looks aesthetic and appealing and possesses a better optical efficiency.

In accordance with the invention such object is met by an anti-glare cap and by a clamping element which is arranged between an end region on the side of the cover and the anti-glare cap for the fixture of the latter onto the shroud, which clamping element is mounted to the shroud on one hand and to the anti-glare cap on the other hand.

Preferably the clamping element is a ring having radially inner first spring elements distant from each other for mounting of the clamping element at the end region of the shroud, and having radially outer second spring elements for supporting the anti-glare cap.

Thereby the clamping element at first as a blank can be stamped out from a heat resistant and springy flat material, e. g. from spring steel.

The first spring elements advantageously are first spring tabs essentially in the plane of the ring protruding towards the ring's centre and shaped such that they are slidable under tension onto the end region of the shroud on the side of the cover whereby the ring is affixed thereto. Thereby the arrangement is structured so that, particularly in the presence of a shroud with an open end towards the cover, the ring has a radial distance from the end region of the shroud, which distance is bridged by the spring tabs being distant from each other circumferentially, such that at least one passage is guaranteed for the current back lead between shroud and ring.

Preferably the shaping of the first spring elements is done by means of a first bending of an interim section of the first spring elements each out of the plane of the ring and in a radial distance from same in axial direction, whereby this first bending of the interim sections has been done essentially in a direction parallel to the longitudinal axis of the ring, and by a second bending of an end section each of the interim sections radially inwardly and essentially parallel to the plane of the ring.

Advantageously the second spring elements essentially are second spring tabs protruding from the radially external edge of the ring and extending also essentially axially with regard to the interim sections of the first spring tabs. In a preferred embodiment the second tabs are thereby arranged axially opposite to the first spring tabs.

In an embodiment which has been proved already to be successful in practice, three first spring tabs offset 120° from each other along the internal circumference and four second spring tabs offset 90° from each other along the external circumference are provided. Thereby it is to be understood that numbers of spring tabs deviating therefrom can be provided as long as proper centering of the anti-glare cap on the open end of the shroud can be guaranteed.

The shroud is preferably circular in section and in a preferred embodiment has a section shaped as a truncated cone tapering down towards the base and a section shaped as a hollow cylinder extending towards the cover. Because its fixation in the base is done by means of a region of the truncated cone which is the smallest in diameter, the reflector area remains as large as possible, i. e. the blind spot or the passage through the reflector can remain particularly small by which the optical efficiency is enhanced. On the other hand a shroud being cylindrical throughout which could be used also and is simpler and less costly in manufacture, could find application, as the case may be, when an arc tube would be used which is especially small.

The hollow cylindrical section has in the wall of its free end an enlargement or a reduction in diameter as a catch over which during assembly the first spring elements resiliently yielding are slidable and on which they can snap on so that some sort of anchoring at the ring takes place.

In a preferred embodiment an enlargement of diameter is provided which is formed as a relatively short truncated cone shaped expansion at the edge of which the first spring tabs with their end sections are abuttable.

Thereby the arrangement is such that the interim sections are not exactly parallel to the longitudinal axis of the ring but, corresponding to the small acute angle between the truncated cone shaped expansion and the longitudinal axis of the shroud, bent a little bit radially outwardly so that the interim sections, after the clamping element having been slid onto the expansion, while the first spring tabs are resiliently excursing from the plane of the ring, after the spring tabs having sprung back, can abut at the outer surface of the expansion, so-to-say gripping behind same, and effect an anchoring of the clamping element onto the end region of the shroud.

The anti-glare cap is slideable onto the clamping element such that the second spring tabs under tension can abut at the inner surface of the anti-glare cap. The outer diameter of the ring for that is formed a little bit smaller than the diameter of the internal surface of the anti-glare cap, whereas the second spring tabs are slanted a little bit radially outwardly and not before sliding-on of the anti-glare cap yield radially inwardly and abut in a parallel manner at the internal surface of the anti-glare cap.

The anti-glare cap, preferably having a hollow cylindrical section and a truncated cone section joining thereto and extending towards the cover, in a distance from the free edge of its hollow cylindrical section comprises an inner shoulder as a limitation of the slide-on or as a stop, resp., at which when slid on the ring can abut with its external peripheral region, whereas at the shoulder surface of the inner shoulder appertaining to the inner surface and present between the edge and the stop, the external surfaces of the second spring tabs can abut.

The cone shaped section of the anti-glare cap advantageously is broken through by three cutouts offset from each other by 120 in circumferential direction which are separated from each other by small webs, such that the heat generated at the end of the arc tube most possibly can be radiated or dissipated, resp. But use of a closed anti-glare cap is possible as well so that no direct light will be emitted in the forward direction.

The invention and its advantageous further developments are explained in more detail as follows in view of the attached drawings.

BRIEF DESCRIPTION OF THE DRAWINGS

It is shown in.

DETAILED DESCRIPTION OF THE PREFERRED EMBODIMENT(S)

Figure 1:
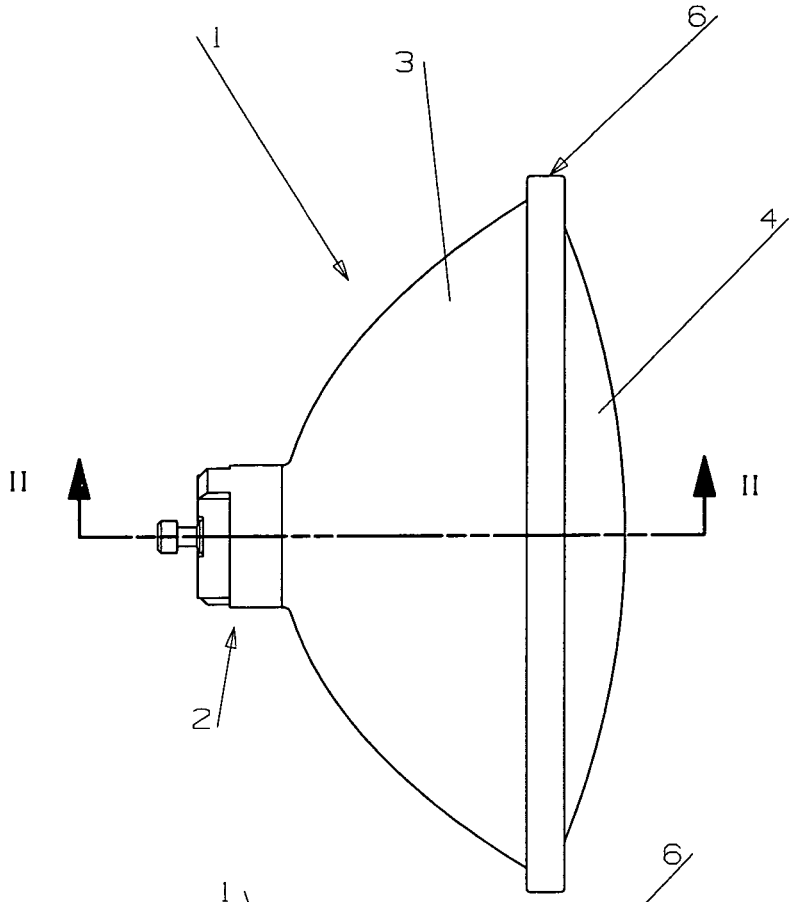
FIG. 1 a side view of an embodiment of a lamp in accordance with the invention.
Figure 2:
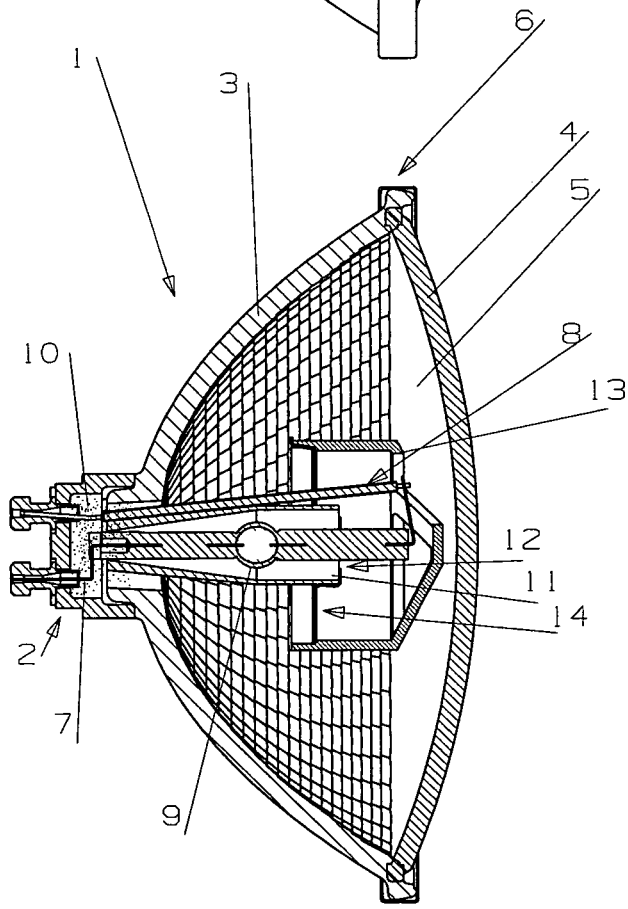
FIG. 2 a section through the lamp along the line II—II in FIG. 1.
Figure 3:
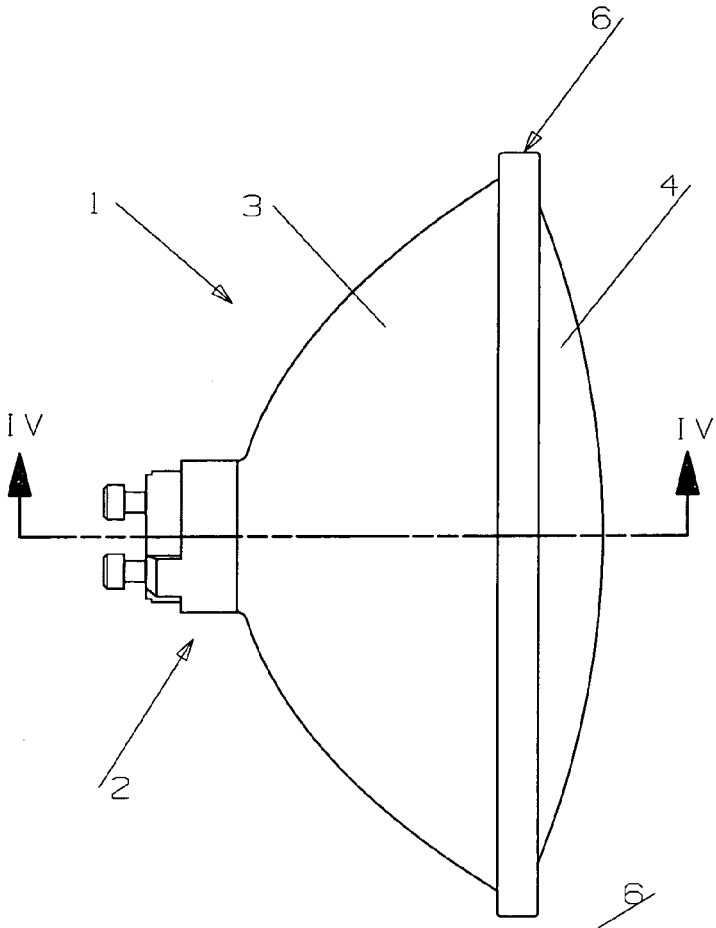
FIG. 3 a side view corresponding to FIG. 2 of the lamp in closed state.
Figure 4:
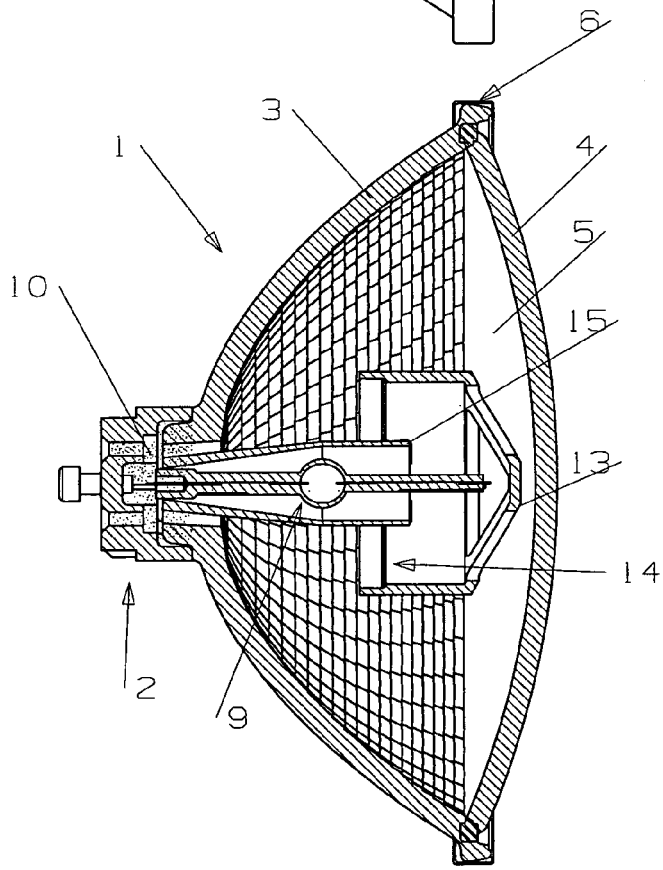
FIG. 4 a section through the lamp along the line IV—IV in FIG. 3.

The embodiment of the lamp 1 according to the invention as represented by the drawings, especially to be seen from FIG. 1 to 4, comprises a reflector 3 with a base 2 and having a cover 4 which e. g. can be a lens, both being connected with each other along their circumferences 6 while forming an inner cavity 5. In this embodiment a two-ended arc tube 9 arranged essentially coaxially within cavity 5 and mounted in base 2 by means of a back lead 8 for electric current arranged on the side of the cover 4. Further a shroud (11) surrounding the arc tube (9) and being fixable in the base (2) by means of cement (10) is provided which in this case is open towards the cover 4.

In accordance with the invention an anti-glare cap 13 and a clamping element 14 which is arranged between end region 12 on the side of the cover 4 and the anti-glare cap 13 for the fixture of the latter onto the shroud 11, which clamping element 14 on the one hand is mounted to the shroud 11 and on the other hand to the anti-glare cap 13.

Because in this case the shroud 11 is open towards cover 4, see edge 15 (FIG. 4), back lead 8 runs to base 2 out of this open end between clamping element 14 and shroud 11 external of the latter.

Figure 8:
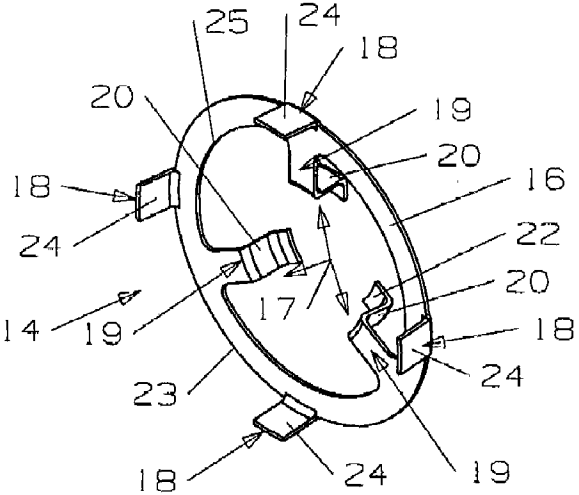
FIG. 8 a perspective slanted view of the clamping ring in accordance with FIG. 5 and 7.
Figure 7:
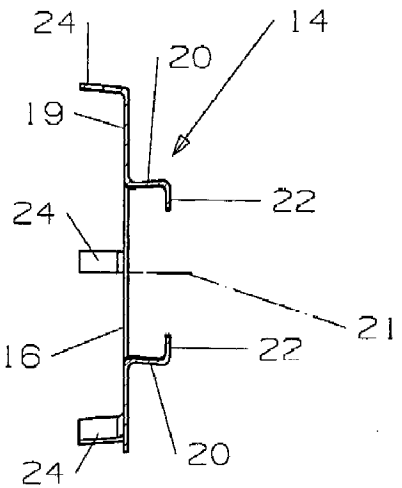
FIG. 7 a section along the line VII—VII in FIG. 5.
Figure 6:
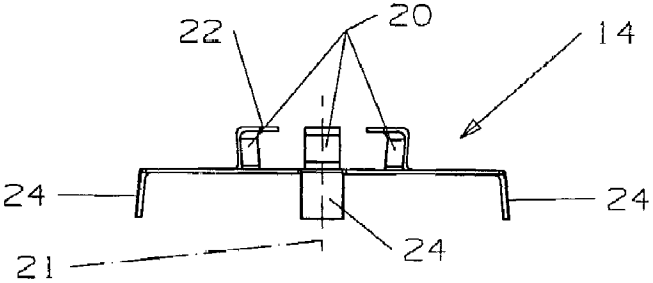
FIG. 6 a side view of the clamping element in the direction of arrow VI in FIG. 5.
Figure 5:
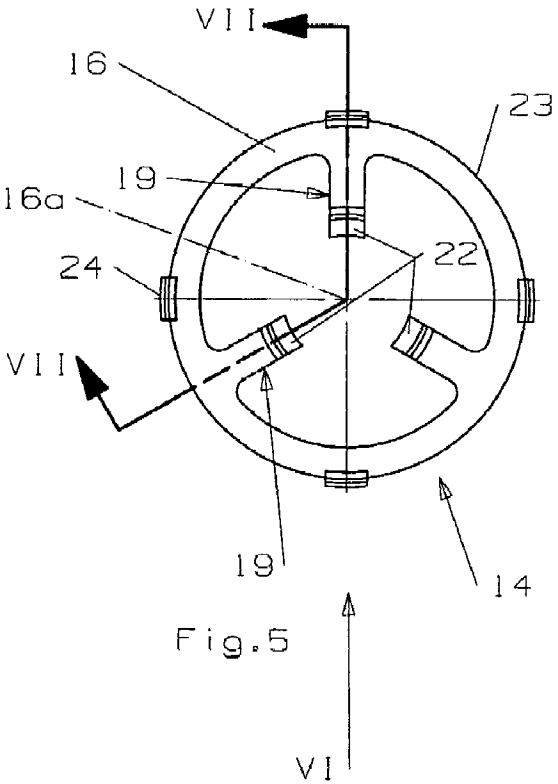
FIG. 5 a plan view of a clamping element formed as a ring.

In the preferred embodiment shown the clamping element 14 (FIG. 5 to 8) is a ring 16 having radially inner first spring elements 17 distant from each other for mounting the clamping element 14 at the end region 12 of the shroud 11, and having radially outer second spring elements 18 for supporting the anti-glare cap 13. Thereby the clamping element 14 can be stamped out initially from a sheet of spring metal as a flat blank prior to bringing it into its final shape by bending.

As is readily apparent from FIG. 5 to 8, the first spring elements 17 are first spring tabs 19 essentially in the plane of the ring 16) protruding towards the ring's centre 16*a* and shaped such that they are slideable under tension onto the end region 12 of the shroud 11 on the side of the cover 4 whereby the clamping element 14 is affixed thereto.

The ring 16 has all around a distance R from the end region 12 of the shroud 11, which distance is bridged by the first spring tabs 19 being distant from each other circumferentially, such that at least one passage 36 is guaranteed for the current back lead between shroud 11 and ring 16.

The shaping of the first spring elements 17 is done by means of a first bending of an interim section 20 of the first spring elements 19 each out of the plane of the ring 16 and in a radial distance R from same in axial direction, whereby this first bending of the interim sections 20 has been done essentially in a direction parallel to the longitudinal axis 21 of ring 16, and by a second bending of an end section 22 each of the interim sections 20 radially inwardly and essentially parallel to the plane of the ring 16.

The second spring elements 18 essentially are second spring tabs 24 protruding from the radially external edge 23 of the ring 16 and extending also essentially axially with regard to the interim sections 20 of the first spring tabs 19, the second spring tabs 24 being arranged axially opposite to the first spring tabs 19.

In the preferred embodiment shown three first spring tabs 19 offset 120° from each other along the internal circumference 25 of the ring 16 and four second spring tabs 24 offset 90° from each other along the external circumference 23 of the ring 16 are provided.

Figure 10:
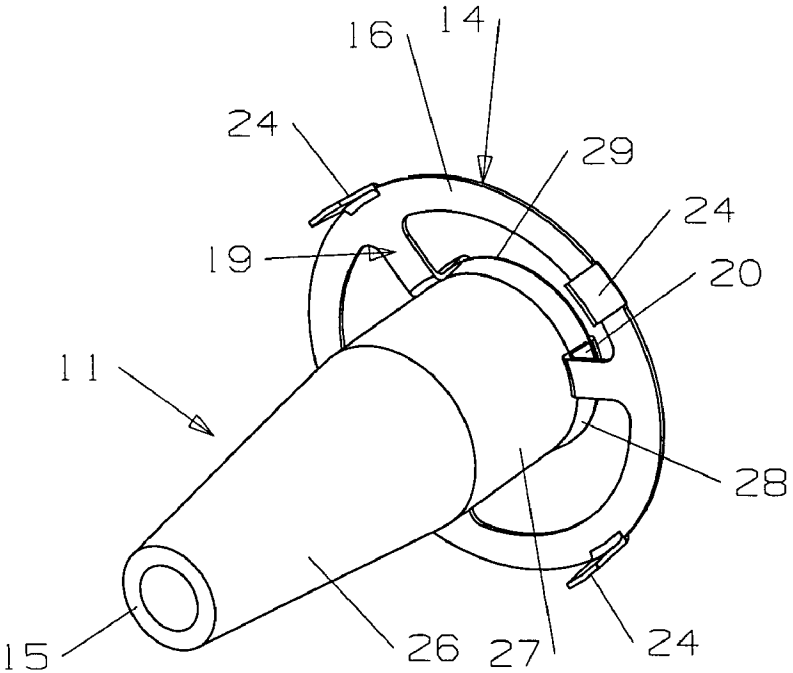
FIG. 10 a second perspective slanted view of the arrangement according to FIG. 9.
Figure 9:
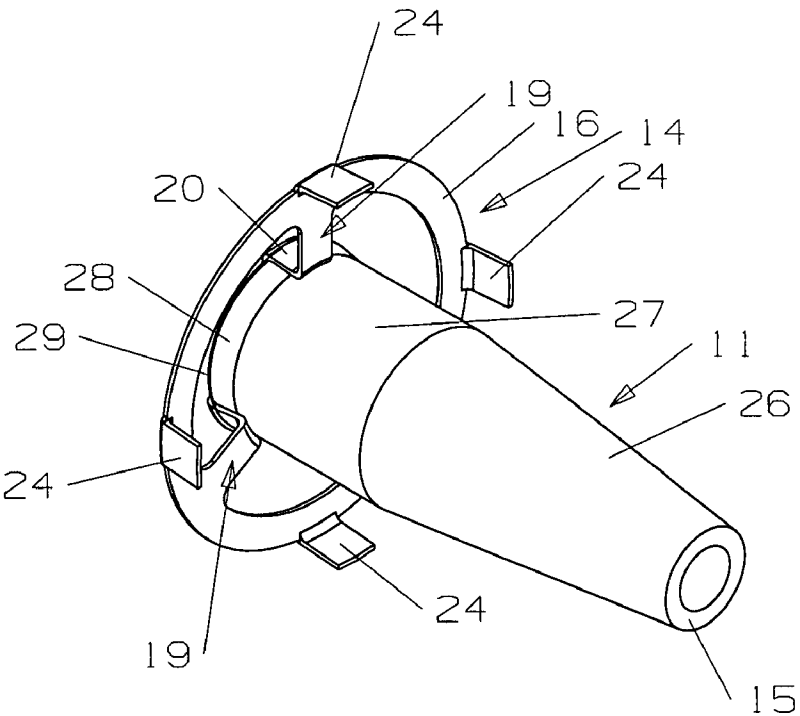
FIG. 9 a first perspective slanted view of an advantageous shroud with mounted clamping element.
Figure 13:
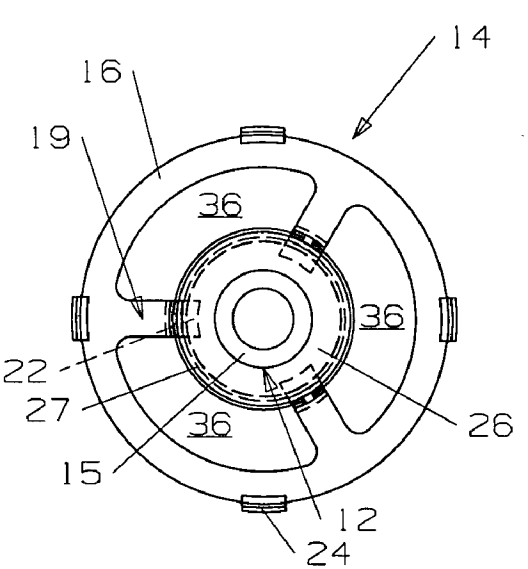
FIG. 13 a view of the arrangement in the direction of arrow XIII—XIII in FIG. 11.
Figure 11:
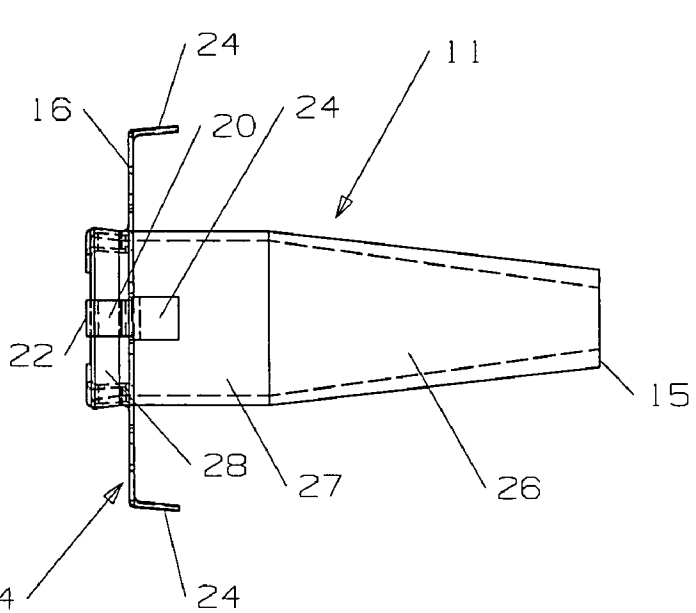
FIG. 11 a side view of the arrangement according to FIG. 9 and 10.
Figure 12:
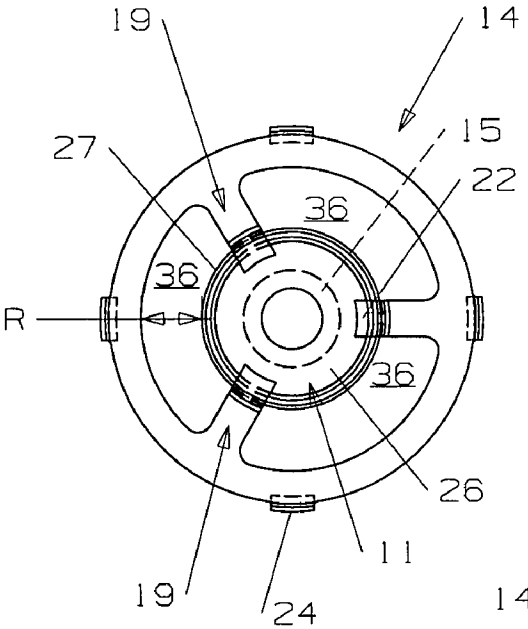
FIG. 12 a view of the arrangement in the direction of arrow XII in FIG. 11.
Figure 14:
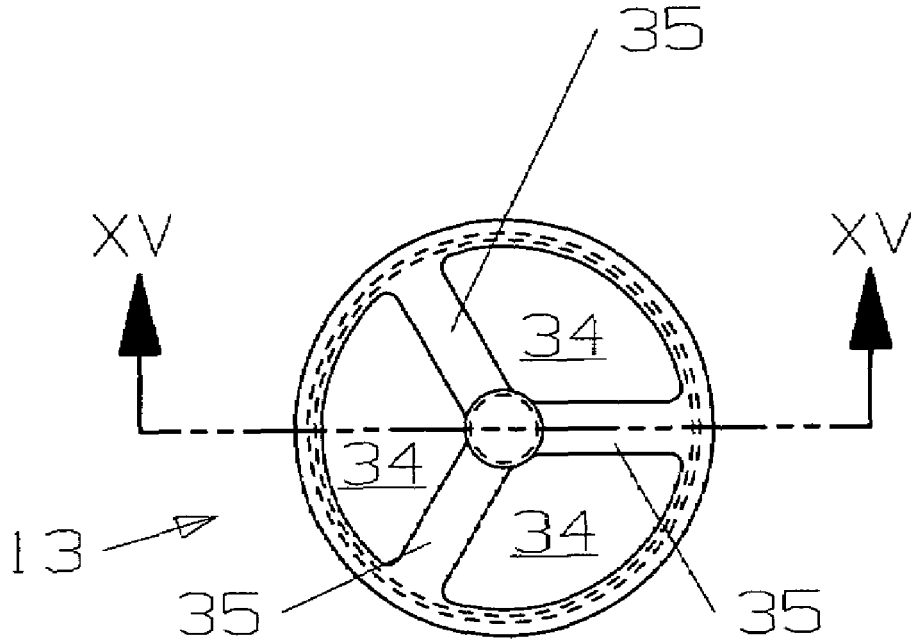
FIG. 14 a plan view of an anti-glare cap in the direction of arrow XIV in FIG. 15.
Figure 15:
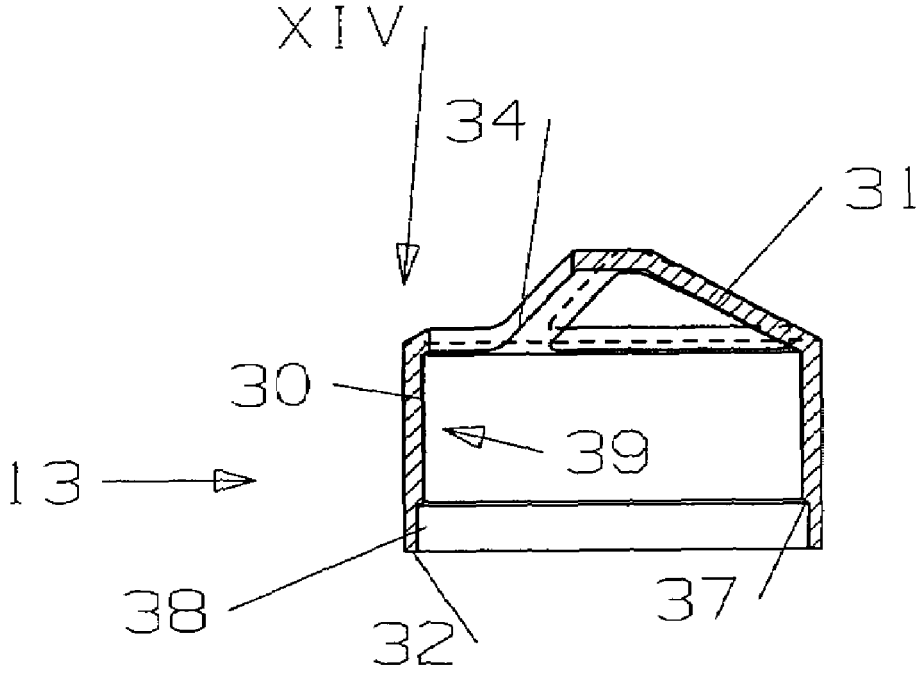
FIG. 15 a section along the line XV—XV in FIG. 14.

Shroud 11 to be taken from FIG. 9 to 13 in particular detail in this embodiment is circular in section and has a section 26 shaped as a truncated cone tapering down towards the base 2 and a section 27 shaped as a hollow cylinder extending towards the cover 4. Since the shroud 11 is manufactured from a single piece of cylindrical tube and by ductile shaping of the glass material in correspondingly heated state of the region forming the hollow truncated cone section, a continually increasing thickening of the wall width takes place in the direction of the tapering end of section 26 which is accommodated in the cement, to be seen particularly from FIG. 9 to 13.

Advantageously the hollow cylindrical section 27 in the wall of its free end (edge 29) has an enlargement or a reduction in diameter as a catch over which during assembly the first spring tabs 19 of the clamping element 14 resiliently yielding are slidable and on which they can snap on, whereby the back lead 8 passes between two first spring tabs 17, resp., from the open end of the shroud 11 to the base 2.

In the preferred embodiment shown an enlargement of diameter is provided which is formed as a relatively short truncated cone shaped expansion 28 (FIGS. 9 and 10) at the edge 29 of which the first spring tabs 19 with their end sections 22 are abuttable. From this derives that the width of the expansion 28 corresponds to the extension of the interim sections 20.

The anti-glare cap 13 is slideable onto the clamping element 14 such that the second spring tabs 24 under tension can abut at the inner surface 39 of the anti-glare cap 13.

The anti-glare cap 13, having a hollow cylindrical section 30 and a truncated cone section 31 joining thereto and extending towards the cover 4, in a distance from the free edge 32 of its hollow cylindrical section 30 comprises an inner shoulder as a limitation of the slide-on or as a stop 37, resp., at which when slid on the ring 16 can abut with its external peripheral region, whereas at the shoulder surface 38 of the inner shoulder appertaining to the inner surface 29 and present between the edge 32 and the stop 37, the external surfaces of the second spring tabs (24) can abut.

The cone shaped section 31 is broken through by three cutouts 34 offset from each other by 120° in circumferential direction which are separated from each other by relatively small webs 35.

In the embodiment elucidated above a two-ended arc tube in the form of a discharge lamp is used, more specifically, an HID(High Intensity Discharge)-lamp. It is emphasized, however, that in the frame of the invention also e. g. halogen lamps can be used as arc tubes which can be one-ended as well as two-ended, so that, as the case may be, also a shroud can be used which is closed towards the cover. Besides there are arc tubes in the form of one-ended discharge lamps which can be used either.

The invention claimed is:

1. A lamp (1) for general illumination purposes having a reflector (3) with a base (2) and having a cover (4), both being connected with each other along their circumferences (6) while forming an inner cavity (5), comprising an arc tube (9) arranged essentially coaxially within the cavity (5) and mounted in the base (2), and a shroud (11) surrounding the arc tube (9) and being fixable in the base (2) by means of cement (10), wherein an anti-glare cap (13), and a clamping element (14) which is arranged between an end region (12) on the side of the cover (4) and the anti-glare cap (13) for the fixture of the anti-glare cap onto the shroud (11), which clamping element (14) is mounted to the shroud (11) on one side and to the anti-glare cap (13) on the other side.

2. A lamp (1) according to claim 1, wherein the clamping element (14) is a ring (16), having radially inner first spring elements (17) distant from each other for mounting of the clamping element (14) at the end region (12) of the shroud (11), and having radially outer second spring elements (18) for supporting the anti-glare cap (13).

3. A lamp according to claim 2, wherein the clamping element (14) is stamped out initially from a sheet of spring metal as a flat blank prior to bringing it into its final shape by bending.

4. A lamp according to claim 2, wherein the first spring elements (17) are first spring tabs (19) essentially in the plane of the ring (16) protruding towards the ring's centre (16*a*) and shaped such that they are slidable under tension onto the end region (12) of the shroud (11) on the side of the cover (4) whereby the clamping element (14) is affixed thereto.

5. A lamp according to claim 4 with an open end towards the cover (4), wherein the ring (16) has all around a distance R from the end region (12) of the shroud (11), which distance is bridged by the first spring tabs (19) being distant from each other circumferentially, such that at least one passage (36) is guaranteed for the current back lead between shroud (11) and ring (16).

6. A lamp according to claim 4, wherein the shaping of the first spring elements (17) is done by means of a first bending of an interim section (20) of the first spring elements (19) each out of the plane of the ring (16) and in a radial distance (R) from same in axial direction, whereby this first bending of the interim sections (20) has been done essentially in a direction parallel to the longitudinal axis (21) of the ring (16), and by a second bending of an end section (22) each of the interim sections (20) radially inwardly and essentially parallel to the plane of the ring (16).

7. A lamp according to claim 2, wherein the second spring elements (18) essentially are second spring tabs (24) protruding from the radially external edge (23) of the ring (16) and extending also essentially axially with regard to the interim sections (20) of the first spring tabs (19), the second spring tabs (24) being arranged axially opposite to the first spring tabs (19).

8. A lamp according to claim 2, wherein three first spring tabs (19) offset 120° from each other along the internal circumference (25) of the ring (16) and four second spring tabs (24) offset 90° from each other along the external circumference (23) of the ring (16) are provided.

9. A lamp according to claim 1, wherein the shroud (11) is circular in section and has a section (26) shaped as a truncated cone tapering down towards the base (2) and a section (27) shaped as a hollow cylinder extending towards the cover (4).

10. A lamp according to claim 9, wherein the hollow cylindrical section (27) has in a wall of its free end (edge 29) an enlargement or a reduction in diameter as a catch over which during assembly the first spring tabs (19) of the clamping element (14) resiliently yielding are slidable and on which they can snap on so that anchoring of the clamping element (14) at the ring (16) takes place.

11. A lamp according to claim 9, wherein an enlargement of the diameter is provided which is formed as a relatively short truncated cone shaped expansion (28) at the edge (29) of which the first spring tabs (19) with their end sections (22) are abuttable.

12. A lamp according to claim 7 or 8, wherein the anti-glare cap (13) is slideable onto the clamping element (14) such that the second spring tabs (24) under tension can abut at the inner surface (39) of the anti-glare cap (13).

13. A lamp according to claim 12, wherein the anti-glare cap (13), having a hollow cylindrical section (30) and a truncated cone section (31) joining thereto and extending towards the cover (4), in a distance from the free edge (32) of its hollow cylindrical section (30) comprises an inner shoulder as a limitation of the slide-on or as a stop (37), at which when slid on the ring (16) can abut with its external peripheral region, whereas at the shoulder surface (38) of the inner shoulder appertaining to the inner surface (29) and present between the edge (32) and the stop (37), the external surfaces of the second spring tabs (24) can abut.

14. A lamp according to claim 13, characterized in that the cone shaped section (31) is broken through by three cutouts (34) offset from each other by 120° in circumferential direction which are separated from each other by small webs (35).

* * * * *